United States Patent [19]

Beam et al.

[11] Patent Number: 4,504,037

[45] Date of Patent: Mar. 12, 1985

[54] RAM BLOWOUT PREVENTER SECURING AND RETRACTING APPARATUS

[75] Inventors: Clark W. Beam, Houston; Mark K. Crutchfield, Kingwood, both of Tex.

[73] Assignee: Hydril Company, Los Angeles, Calif.

[21] Appl. No.: 535,676

[22] Filed: Sep. 26, 1983

[51] Int. Cl.[3] ..... E21B 33/06

[52] U.S. Cl. ..... 251/1 A; 251/1 R; 92/128; 92/161; 137/315

[58] Field of Search ..... 92/128, 161, 169; 411/427, 429; 251/1 R, 1 A; 137/315

[56] References Cited

U.S. PATENT DOCUMENTS

| | | | |
|---|---|---|---|
| 1,381,437 | 6/1921 | Smith | 411/429 X |
| 2,853,347 | 9/1958 | Cooper, Jr. | 92/128 X |
| 3,538,575 | 11/1970 | Roland | 92/128 X |
| 3,647,174 | 3/1972 | Le Rouax | 251/1 A |
| 3,918,478 | 11/1975 | Le Rouax | 137/315 |
| 3,925,876 | 12/1975 | Curtis | 29/509 |
| 4,437,643 | 3/1984 | Brakhage, Jr. et al. | 251/1 A |

FOREIGN PATENT DOCUMENTS

| | | | |
|---|---|---|---|
| 122877 | 12/1946 | Australia | 92/128 |
| 569384 | 1/1959 | Canada | 92/128 |

OTHER PUBLICATIONS

1978, "Official Oil Well Drilling & Production Equipment Catalogue", p. 1219.

Hydril Equipment Catalogue, #812, p. 11.

*Primary Examiner*—Samuel Scott

*Assistant Examiner*—Allen J. Flanigan

*Attorney, Agent, or Firm*—Dodge & Bush

[57] ABSTRACT

Bonnet securing and retracting apparatus for a ram blowout preventer is disclosed. The ram blowout preventer bonnet is retained by two bonnet studs and nuts and by bonnet bolts. Bearings in the bonnet are provided to slide on bonnet studs. To retract the bonnet from the ram blowout preventer housing, the bonnet nuts and bolts are removed, and the bonnet may be slid on the bonnet studs outwardly from the housing. Removable stop pins in the bonnet studs prevent the bonnet from sliding off the studs. After the pins are removed, the bonnet may be completely removed from the housing.

This abstract of the disclosure is neither intended to define the scope of the invention, which is measured by the claims, nor is it intended to limit the invention in any way.

9 Claims, 3 Drawing Figures

FIG. 2
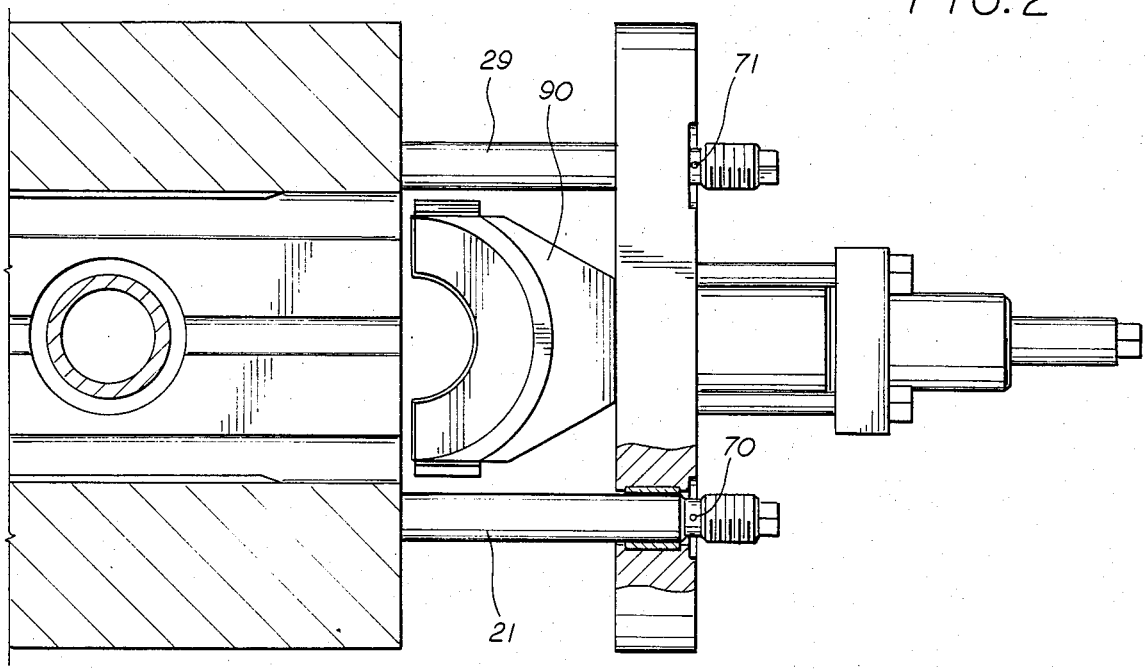
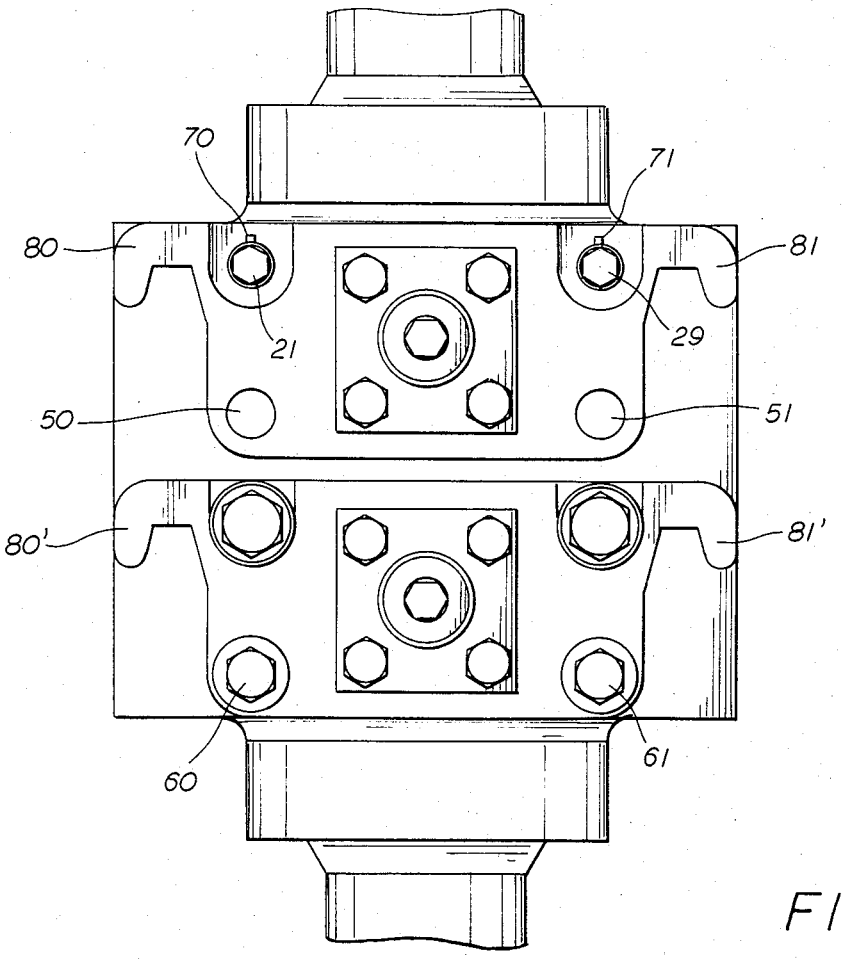
FIG. 3

RAM BLOWOUT PREVENTER SECURING AND RETRACTING APPARATUS

BACKGROUND OF THE INVENTION

1. Field of the Invention

This invention relates generally to ram blowout preventers. In particular, the invention relates to apparatus for securing the bonnet to the housing of a ram blowout preventer. Still more particularly, the invention relates to an apparatus for securing and retracting a bonnet from a blowout preventer housing.

2. Description of the Prior Art

Various apparatus is known in the prior art for securing and retracting a bonnet to a ram blowout preventer housing. One prior art apparatus has included a bonnet which is hinged at one side of the blowout preventer body and is secured to the blowout preventer body by means of bonnet bolts. When it is desired to open the bonnet with respect to the blowout preventer housing for the purpose of servicing a packer or ram assembly, the bonnet bolts are disconnected from the bonnet in the housing and the bonnet is moved outwardly on the hinge thereby exposing the ram assembly.

Another prior art apparatus is known by which rods are secured within the body in the blowout preventer housing and the bonnet slidingly engages the rods. The bonnet housing is constructed to completely envelope the rods. Separate bonnet bolts are provided to secure the bonnet to the blowout preventer housing. When it is desired to open the bonnet, the bonnet bolts are first removed and then the hydraulic system for closing the ram is engaged thereby forcing the bonnet away from the housing by the action of the hydraulic system. The bonnet slides outwardly from the housing on the rods secured within the housing.

There has developed a need to provide a bonnet securing and retracting apparatus for a ram blowout preventer which is simple and lightweight, a system especially adapted for blowout preventers of limited size and weight which may be used, for example, in a mobile workover blowout preventer system.

SUMMARY OF THE INVENTION

It is therefore an object of the invention to provide a bonnet securing and retracting apparatus which does not require the hydraulics of the blowout preventer system for opening and for closing the bonnet yet is slidable upon bonnet studs secured within the blowout preventer housing.

It is another object of the invention to provide a relatively inexpensive system of simple design for securing and retracting the bonnet to a ram blowout preventer.

The above mentioned objects of the invention as well as other advantages and features of the invention are provided in a bonnet securing and retracting apparatus for a ram blowout preventer in which at least one bonnet stud is secured at its first end in the blowout preventer housing. The bonnet stud has a threaded external surface at its second end and the stud has a substantially smooth surface between its two ends. Bearing surfaces in the bonnet of the ram blowout preventer are provided for sliding support of the bonnet on the smooth surface of the bonnet stud.

At least one removable bonnet nut is provided having a cylindrical body with an open first end defining an annular surface about the end of the nut and an internally threaded surface at its second end. When the bonnet is secured to the blowout preventer housing, the bonnet is slid inwardly on the bonnet stud and the cylindrical body of the bonnet nut is provided about the portion of the bonnet stud extending outwardly from the bonnet until the threaded surface at the second end of the bonnet nut threadingly mates with the external surface of the bonnet stud, and in cooperation with the annular surface of its first end bearing against the bonnet, thereby secures the bonnet to the blowout preventer housing.

When it is desired to remove the bonnet from the blowout preventer housing, the bonnet nut is removed from the bonnet stud and the bonnet may be slid outwardly on the bonnet stud thereby providing access to the ram assembly outside the blowout preventer housing.

Stopping means are provided for preventing the outwardly sliding of the bonnet off of the bonnet stud. The stopping means is preferably a stop pin affixed in the bonnet stud near its second end with the pin extending perpendicularly from the surface of the stud, whereby the bonnet may be slid outwardly on the bonnet stud until the end of the bonnet engages the stop pin.

Where it is desired to completely remove the bonnet from the bonnet stud, the stop pin may be removed and the bonnet withdrawn completely from the bonnet stud.

In a preferred embodiment of the invention, the bonnet is secured to the housing by means of two studs and two bonnet nuts as described above. In addition, two bonnet bolts are provided through holes into threaded engagement with a threaded bore in the housing wall. When it is desired to remove the bonnet from the blowout preventer housing, the bonnet bolts and the bonnet nuts are removed and the bonnet is slid outwardly on the two bonnet studs as previously described.

BRIEF DESCRIPTION OF THE DRAWINGS

The objects, advantages and features of the invention will become more apparent by reference to the drawings which are appended hereto and wherein like numerals indicate like parts and wherein an illustrative embodiment of the invention is shown, of which:

FIG. 2 is a top view taken along section 2—2 of FIG. 1 and showing a part of the blowout preventer, according to the invention, in which the bonnet has been withdrawn from the blowout preventer housing providing access to the ram assembly; and FIG. 3 is a side view taken along section 3—3 of FIG. 1 and showing the two bonnets of the blowout preventer, according to the invention, in which the bottom bonnet is secured by means of bonnet nuts and bonnet bolts to the housing of the preventer and the top preventer has its bonnet nuts and bonnet bolts removed.

DESCRIPTION OF THE INVENTION

Figure 1:
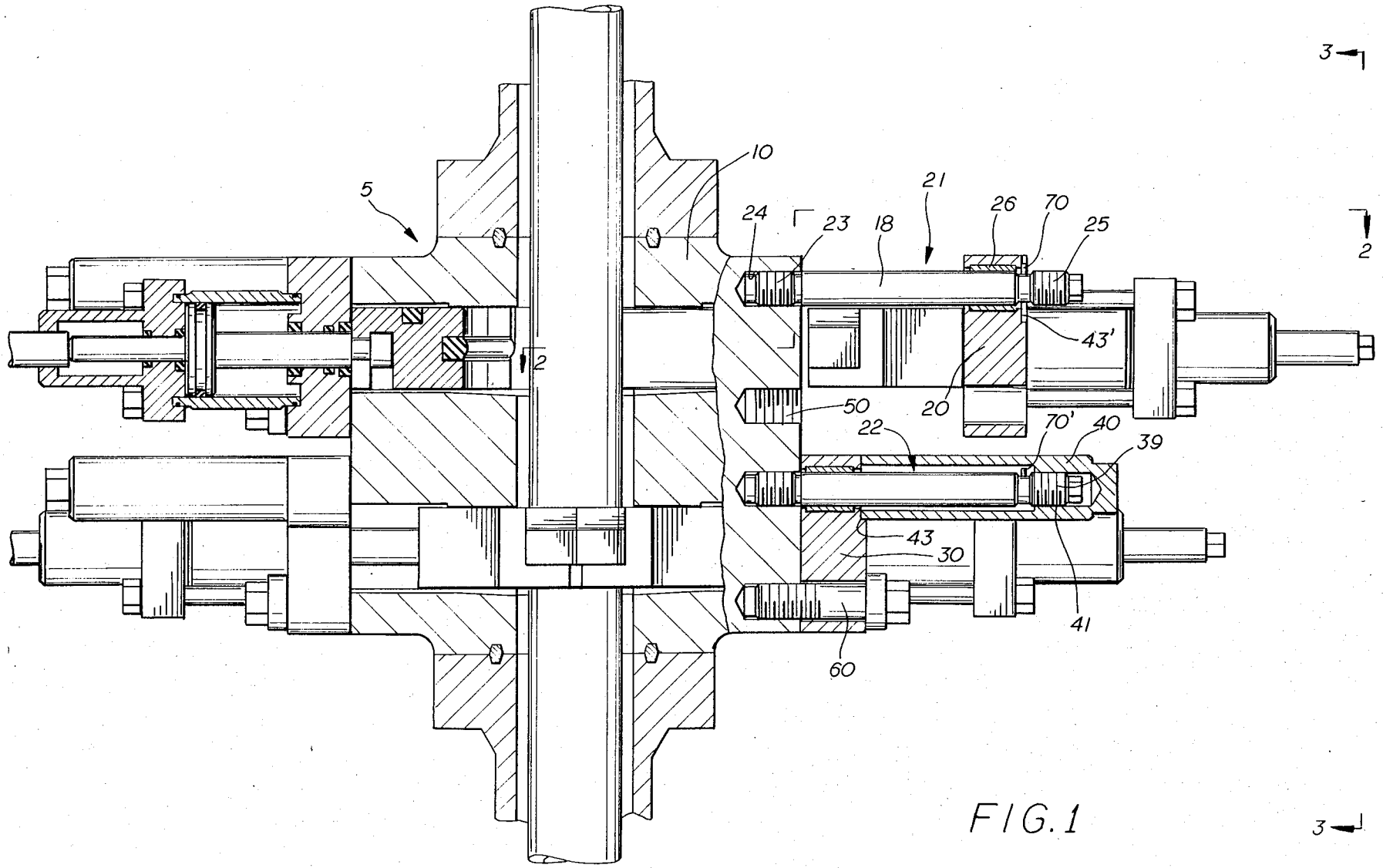
FIG. 1 is a side view of a ram blowout preventer partly in section illustrating the bonnet studs and bonnet nuts, according to the invention, for securing and retracting the bonnet from the blowout preventer housing.

FIG. 1 is a side view of a blowout preventer 5 according to the invention having two ram preventers within a common housing 10. The ram blowout preventer illustrated in the top part of the housing is shown with its bonnet 20 retracted from the blowout preventer housing 10 whereas the blowout preventer in the lower part of the housing 10 is shown with its bonnet 30 secured to the housing 10.

As illustrated in FIGS. 1 and 2, the bonnet 20 in the open position is supported on two bonnet studs 21 and 29. As illustrated in FIG. 1, the bonnet studs are threadedly secured within the bonnet housing 10 as per mating threaded surfaces 23 on the inward end of the bonnet stud 21 and a like surface in the bore 24 in the housing 10. Bonnet stud 29 is secured within housing 10 in a similar fashion as bonnet stud 21 in the side view of FIG. 1.

The bonnet is provided with bearings 26 in the bonnet on which the bonnet may be slidingly supported on the smooth surface 18 of the bonnet stud between ends 23 and 25 of the stud. Preferably the bearings 26 are coated with a synthetic flourine containing resin such as TEFLON® to facilitate the sliding of the bonnet with respect to the smooth surface 18 of the bonnet stud.

As illustrated in the bottom ram apparatus of blowout preventer 5, a bonnet nut 40 is provided for securing the bonnet 30 to the housing 10 when the bonnet is moved inwardly into a closed position. As illustrated, the bonnet nut 40 is a cylindrical member with an inwardly threaded surface 41 adapted for mating with the threads 39 provided at the second end of bonnet stud 22. When the bonnet nut 40 is threadedly made up with threads 39 of the bonnet stud 22, the annular end 42 of bonnet nut 40 engages the outer surface of bonnet 30 acting to secure the bonnet 30 to the housing 10. Preferably a counterbore 43 is provided in the outer surface of bonnet 30 (and likewise counterbore 43' in outer surface of bonnet 20) for the end of the nut 40 (or nut for the upper blowout preventer apparatus) to bear against.

Bonnet bolts 60 are provided below the bonnet studs 22 in order to further secure the bonnet 30 to the housing 10. Similar bonnet bolts and bonnet nuts are of course used to secure bonnet 20 to housing 10 for the upper ram apparatus of blowout preventer 5.

Also provided near the outer end of the bonnet studs are stop pins 70 and 70', as illustrated in FIG. 1. Stop pins 70 and 71 on the studs 21 and 29 of the upper blowout preventer apparatus are illustrated in FIGS. 2 and 3 and are provided so that when the bonnet 20 (or bonnet 30) is pulled outwardly from the housing 10 it cannot be pulled completely off the studs 21 and 29, but rather is stopped by the engagement of the stop pins 70 and 71 with the outer surface of the bonnet 20 (or bonnet 30).

Advantageously, ears or hand holds 80 and 81 and 80' and 81' are provided respectively for manually pushing or pulling the bonnets 20 and 30 inwardly and outwardly on the bonnet studs secured to the housing 10. When it is desired to completely remove bonnet 20 or bonnet 30 from the blowout preventer housing, the pins 70, 71 and 70' and 71' (not illustrated), are removed from the bonnet stud thereby enabling the bonnets 20 or 30 to be slid outwardly over the end of the bonnet studs.

FIG. 2 illustrates in a top view, the uppermost bonnet 20 outwardly slid on studs 21 and 29 away from the housing 10. In the open position, as illustrated in FIG. 2, the bonnet 20 provides access to the ram assembly 90 for replacement of a packer or ram for servicing of the blowout preventer.

FIG. 3 shows in an end view, the uppermost blowout preventer with the ram nuts removed from studs 21 and 29 and the ram bolts removed from bores 50 and 51 in the bonnet 20. FIG. 3 also shows the bottom blowout preventer in a closed position in which ram nuts 40 and 44 and ram bolts 60 and 61 are in place securing the bonnet 30 to the housing 10.

Various modifications and alterations in the described structures will be apparent to those skilled in the art of the foregoing description which does not depart from the spirit of the invention. For this reason, these changes are desired to be included in the appended claims. The appended claims recite the only limitation to the present invention and the descriptive manner that is employed for setting forth the embodiments and is to be interpreted as illustrative and not limitative.

What is claimed is:

1. Bonnet securing and retracting apparatus for a ram blowout preventer comprising, at least one bonnet stud secured at its first end in the blowout preventer housing and having a threaded external surface at its second end, the stud having a substantially smooth surface between its two ends, bearing means in the bonnet of the ram blowout preventer for slidingly supporting the bonnet on the smooth surface of the bonnet stud, and at least one removable bonnet nut having a cylindrical body with an open first end defining an annular surface about the end of the nut and an internally threaded surface at its second end, whereby when the bonnet is slid inwardly on said bonnet stud, the cylindrical body of the bonnet nut may be provided about the portion of the bonnet stud extending outwardly from the bonnet until the threaded surface at the second end of the bonnet nut threadingly mates with the external surface of the bonnet stud and in cooperation with the annular surface of its first end bearing against the bonnet thereby securing the bonnet to the blowout preventer housing, and whereby when the bonnet nut is removed from the bonnet stud, the bonnet may be slid outwardly on said bonnet stud.

2. The apparatus of claim 1 further comprising stopping means for preventing the outward sliding of the bonnet off of the bonnet stud.

3. The apparatus of claim 2 wherein the stopping means is a stop pin affixed in the bonnet stud near its second end, the pin extending perpendicularly from the surface of the stud, whereby the bonnet may be slid outwardly on the bonnet stud until the end of the bonnet engages the stop pin.

4. The apparatus of claim 1 wherein the stop pin is removable from the bonnet stud enabling the bonnet to be removed from the bonnet stud.

5. The apparatus of claim 4 wherein the first end of the bonnet stud is threadedly fastened within the wall of the blowout preventer housing.

6. In a ram blowout preventer having a housing and a removable bonnet for inserting or withdrawing a ram assembly in the horizontal bore of the preventer, the improvement comprising, two bonnet studs secured at their respective first ends in the blowout preventer housing and each having threaded external surfaces at their second ends, each stud having a substantially smooth surface between its two ends, bearing means in the bonnet of the ram blowout preventer for slidingly supporting the bonnet on the smooth surface of the bonnet stud, and two removable bonnet nuts, each having a cylindrical body with an open first end defining an engaging surface about the end of the nut and an internally threaded surface at its second end, whereby when the bonnet is slid inwardly on said bonnet studs, the cylindrical body of each bonnet nut may be provided about the end of a respective one of the bonnet studs extending outwardly from the bonnet until the threaded surface at the second end of each bonnet nut threadingly makes-up with the external surface at the second end of each bonnet stud and the engaging surface at the end of each nut engages the bonnet thereby securing the bonnet to the blowout preventer housing, and whereby the bonnet nuts may be unthreaded and removed from the bonnet studs, thereby freeing the bonnet to be slid outwardly on the bonnet studs.

7. The improvement of claim 6 further comprising a stop pin affixed in each bonnet stud near the second end of each bonnet stud, each pin extending perpendicularly from the surface of the respective stud, whereby the bonnet may be slid outwardly on the bonnet stud until the end of the bonnet engages the stop pin.

8. The improvement of claim 7 wherein each stop pin is removable from each of the bonnet studs thereby enabling the bonnet to be removed from the bonnet stud.

9. Bonnet securing and retracting apparatus for a ram blowout preventer comprising, at least one hole in the bonnet, at least one bonnet bolt disposed through the hole in the bonnet and adapted for threaded engagement with a threaded counterbore in the housing for releasably securing the bonnet to the blowout preventer housing, bonnet securing and retracting apparatus for a ram blowout preventer having at least one bonnet stud secured at its first end in the blowout preventer housing and having a threaded external surface at its second end, the stud having a substantially smooth surface between its two ends, bearing means in the bonnet of the ram blowout preventer for slidingly supporting the bonnet on the smooth surface of the bonnet stud, and at least one removable bonnet nut having a cylindrical body with an open first end defining an annular surface about the end of the nut and an internally threaded surface at its second end, whereby when the bonnet is slid inwardly on said bonnet stud, the cylindrical body of the bonnet nut may be provided about the portion of the bonnet stud extending outwardly from the bonnet until the threaded surface at the second end of the bonnet nut threadingly mates with the external surface of the bonnet stud and in cooperation with the annular surface of its first end bearing against the bonnet thereby providing additional securing of the bonnet to the blowout preventer housing, and whereby when the bonnet bolt is disengaged from the blowout preventer housing and the bonnet nut is removed from the bonnet stud, the bonnet may be slid outwardly on said bonnet stud.

* * * * *